US005112062A

United States Patent [19]

Pratt

[11] Patent Number: 5,112,062

[45] Date of Patent: May 12, 1992

[54] SAFETY LAWN DART

[75] Inventor: Kenneth W. Pratt, Ware, Mass.

[73] Assignee: Seneca Sports Inc., Milford, Mass.

[21] Appl. No.: 767,063

[22] Filed: Sep. 27, 1991

[51] Int. Cl.[5] ..... A63B 65/02

[52] U.S. Cl. ..... 273/420; 273/415; 273/417

[58] Field of Search ..... 273/420, 419, 425, 417, 273/416, 415

[56] References Cited

U.S. PATENT DOCUMENTS

| | | | |
|---|---|---|---|
| 1,489,550 | 4/1924 | Shaffer | 273/425 |
| 3,749,402 | 7/1973 | Adickes et al. | 273/415 |
| 4,717,158 | 1/1988 | Pennisi | 273/415 X |

*Primary Examiner*—Paul E. Shapiro
*Attorney, Agent, or Firm*—Fish & Richardson

[57] ABSTRACT

A safety lawn dart for use in lawn games has an elongated shaft, a cushioned, shock-absorbing head and a plurality of feathers or fins mounted for imparting rotational motion during flight. The shaft defines an axis, and one end of the shaft provides a hand grip. The cushioned head is mounted at the other end of the shaft, and has a hub and a wall creating a chamber cushioned to absorb the forces of impact of the dart with a target. The wall has a lower surface disposed to engage a target surface, and may have outwardly extending protrusions. The feathers or fins may be mounted on a sleeve which in turn is mounted for axial and/or rotational movement relative to the shaft.

32 Claims, 6 Drawing Sheets

SAFETY LAWN DART

BACKGROUND OF THE INVENTION

The invention relates to lawn dart games.

As initially configured, lawn darts, e.g. as sold under the trademark "JARTS", consisted of large, metal-tipped darts. The darts were thrown with an underhand motion toward a target ring placed flat upon the ground, the objective being to cause the dart to stick into the ground within the ring. These types of lawn darts were received favorably by the public, in part because the dart typically remained where it landed, thus rewarding an accurate and skillful throw. However, these products were subsequently removed from the market because it was realized that the weight and metal tip of the lawn darts made them a hazard to safety.

More recently, others have proposed lawn games employing darts with blunt tips or similar design features intended to protect participants and others in the vicinity. For example, Wong U.S. Pat. No. 4,946,172 describes a lawn dart with the safety feature of a blunt, deformable nose section. In a second embodiment, a shock absorbing telescopic intermediate section is added to absorb the shock of impact with the ground. Miranda U.S. Pat. No. 4,813,686 describes a shuttlecock with a weighted base and a soft, resilient cushion intended to prevent injury to players.

Unfortunately, safety lawn darts have been less favorably received, at least in part because the relatively lighter weight and blunt tip of these safety darts provide less positive engagement with the ground in the target region. As a result, the safety lawn darts often skip or bounce away from the area of impact, so even if a dart is thrown with great skill and accuracy, the score obtained may not be representative.

SUMMARY OF THE INVENTION

According to one aspect of the invention, a safety lawn dart for use in lawn games comprises an elongated shaft defining an axis, the shaft having a first end region and an opposite second end region, the second end region of the shaft defining a hand gripping region, a cushioned, shock-absorbing head assembly mounted at the first end region of the shaft, the head assembly comprising a hub, at least one wall element defining a chamber, and cushioning means, the wall member defining a lower surface disposed for engagement with a target surface, a sleeve mounted coaxially about the shaft, the sleeve adapted for movement axially and rotationally relative to the shaft, and a plurality of elongated flight members mounted on the sleeve and adapted to impart rotational motion to the sleeve about the axis during flight.

Preferred embodiments of this aspect of the invention may include one or more of the following features. The cushioning means comprises a plurality of pellets disposed within a first segment of the chamber during flight. Preferably, the cushioning means further comprises a resilient member for securing the plurality of pellets within the first segment of the chamber during flight, and the resilient member adapted to permit displacement of the plurality of pellets from the first segment of the chamber toward a second segment of the chamber upon impact of the dart with a target surface. The cushioning means may instead comprise an insert member defining a volume loosely filled with granular material. Preferably, the insert member is disposed within the chamber, and the chamber defines a first open volume region generally above the insert member and a second open volume region generally below the insert member. The lower surface has a plurality of protrusions disposed thereupon, the protrusion extending outwardly from the lower surface for engagement with a target surface. The cushioning means further comprises at least one aperture defined by the wall element of the chamber for displacement of air from the chamber upon impact of the dart with a target surface. The cushioning means further comprises a channel defined by a surface of the wall element annularly about the axis, the channel adapted to facilitate deflection of the wall element of the chamber upon impact of the dart upon a target surface. The sleeve is adapted to move between a first axial position upon the shaft and a second axial position upon the shaft, the sleeve in the first position being relatively more spaced from the head assembly. Preferably, the sleeve is adapted for movement from the first position toward the second position upon impact of the dart with a target surface, and the sleeve is adapted for movement toward the first position during flight of the dart. The hub defines a coaxial orifice, and the shaft extends through the orifice into the chamber. Preferably, the shaft further comprises an enlarged head in the first end region, the head sized to resist dislodgement of the shaft from the hub, outwardly from the chamber. More preferably, the shaft further comprises gripping means in the first end region for engagement with a surface of the hub to resist dislodgement of the shaft from the hub, inwardly toward the chamber. The shaft further comprises a knob element mounted in the second end region and defining a protrusion sized to arrest movement of the sleeve toward the first position. Preferably, the knob element is removably mounted upon the shaft. The lawn dart further comprises a second sleeve disposed about the shaft in the second region and a flange element defining a surface disposed to arrest movement of the sleeve with the elongated flight members mounted thereupon toward the first position. The wall element comprises a generally concave top element having a rim and a generally concave bottom element having a rim, the top element and the bottom element being joined at the opposed rims in manner to define the chamber. The wall element has a lower central region of greater thickness relative to surrounding regions of the wall element.

According to another aspect of the invention, a safety lawn dart for use in lawn games comprises an elongated shaft defining an axis, the shaft having a first end region and an opposite second end region, the second end region of the shaft defining a hand gripping region, a cushioned, shock-absorbing head assembly mounted at the first end region of the shaft, the head assembly comprising a hub, at least one wall element defining a chamber, and cushioning means, the wall member having a plurality of protrusions disposed thereupon, the protrusions extending outwardly from the lower surface and disposed for engagement with a target surface, and a plurality of elongated flight members disposed to extend from the hub and about the shaft, the flight members adapted to impart rotational motion to the dart about the axis during flight.

Preferred embodiments of this aspect of the invention may include one or more of the following features. The wall element comprises a generally concave top element having a rim and a generally concave bottom element having a rim, the top element and the bottom element being joined at the opposed rims in manner to define the chamber. The wall element has a lower central region of greater thickness relative to surrounding regions of the wall element. The hub defines a coaxial orifice, and the shaft extends through the orifice into the chamber. Preferably, the shaft further comprises an enlarged head in the first end region, the head sized to resist dislodgement of the shaft from the hub, outwardly from the chamber.

These and other features and advantages of the invention will be seen from the following description of presently preferred embodiments, and from the claims.

DESCRIPTION OF PRESENTLY PREFERRED EMBODIMENTS

We first briefly describe the drawing.

FIG. 1 is a perspective view of one embodiment of a safety lawn dart of the invention;

FIGS. 2 and 3 are top and bottom plan views, respectively, of the top and bottom dart head assembly elements of the safety lawn dart of FIG. 1, while FIGS. 2*a* and 3*a* are side section views of the top and bottom dart head assembly elements taken at the line 2*a*—2*a* of FIG. 2 and at the line 3*a*—3*a* of FIG. 3, respectively;

Figure 6:
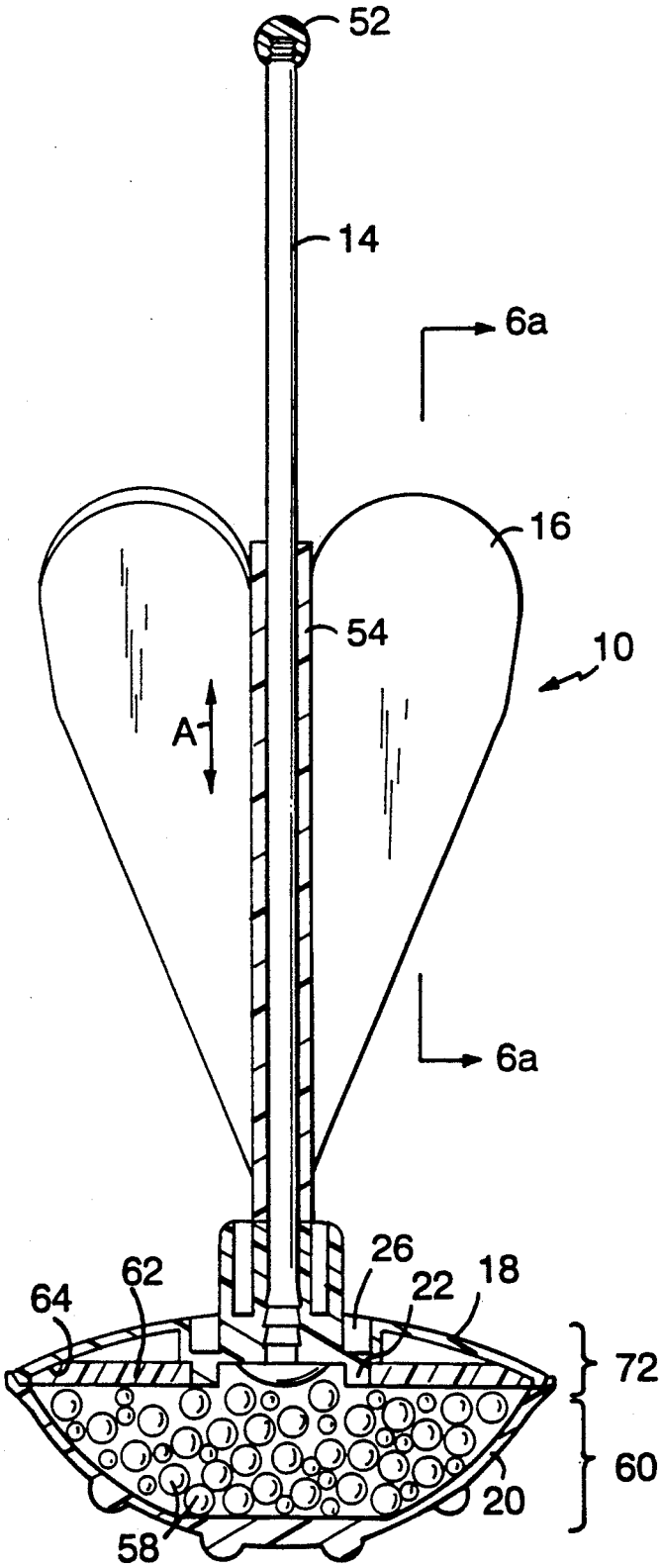
FIG. 6 is a side plan view, partially in section, of the safety lawn dart of FIG. 1.
Figure 6A:
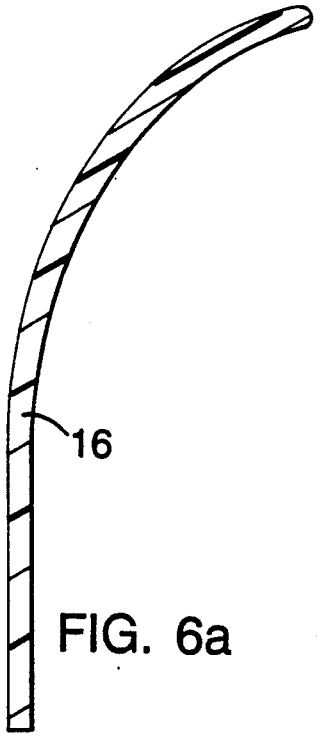
Figure 7:
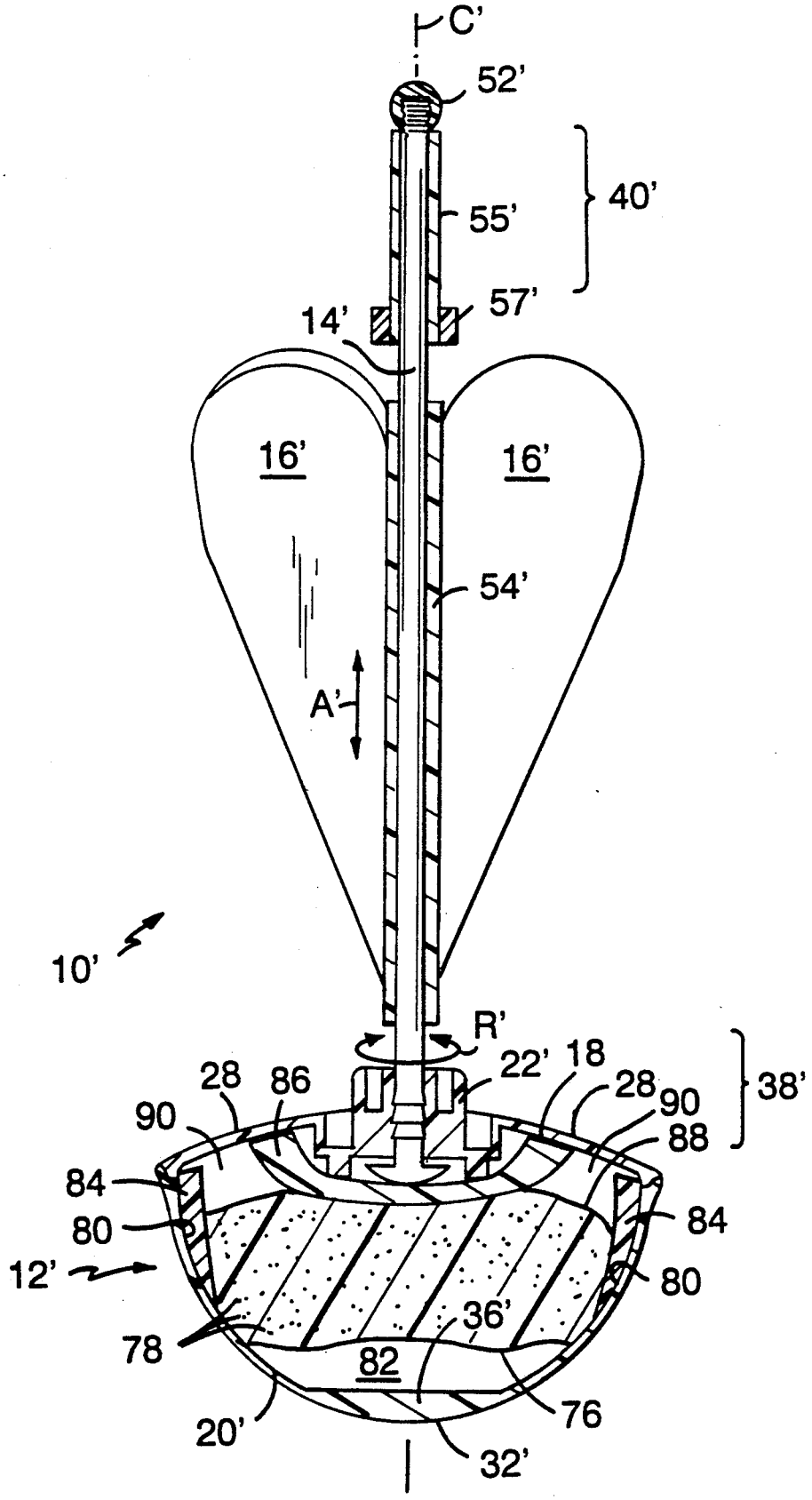
Figure 8:
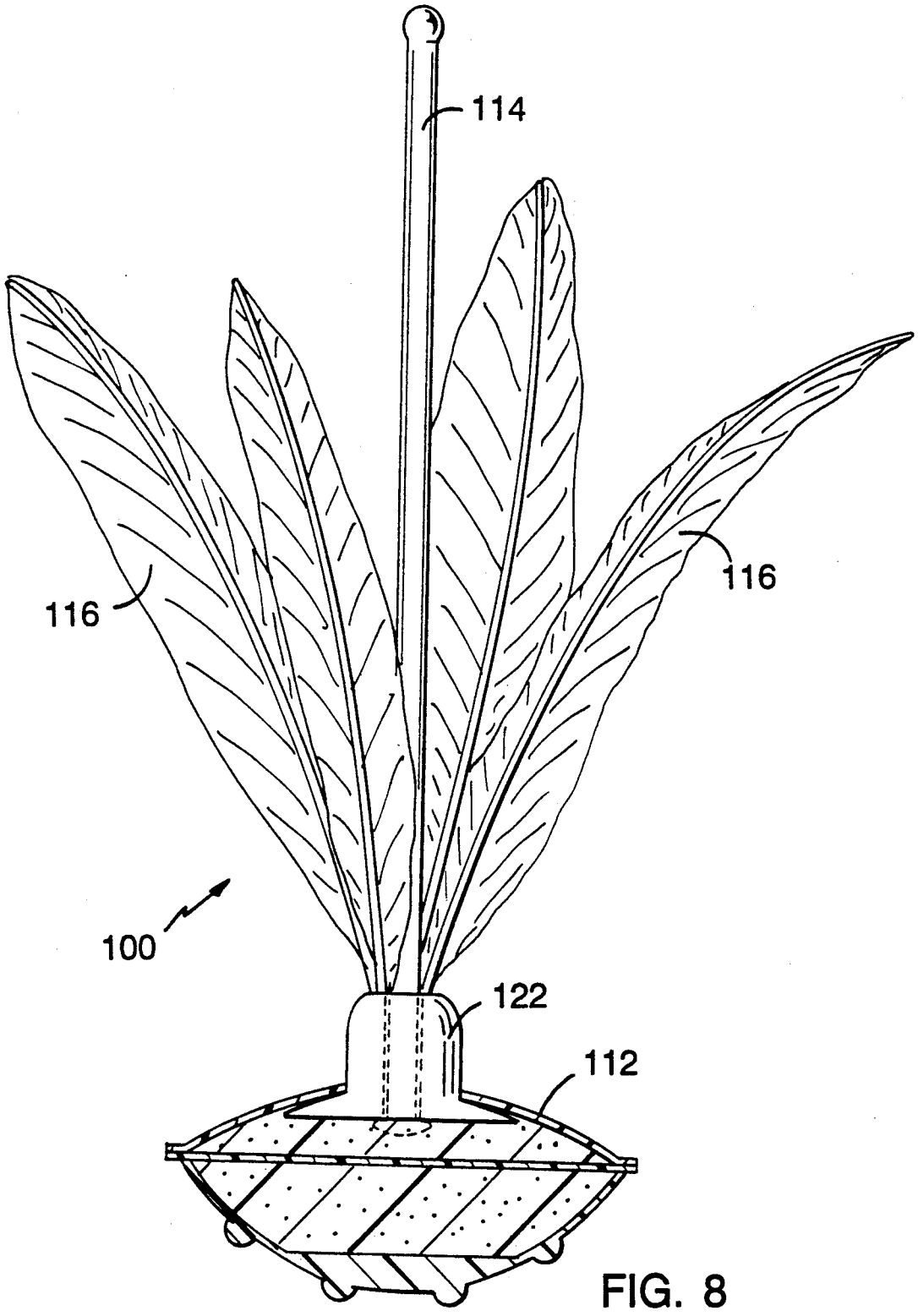

FIG. 6*a* is a side section view of a lawn dart fin, taken at the line 6*a*—6*a* of FIG. 6;

FIG. 7 is a side plan view, partially in section, of another embodiment of a safety lawn dart of the invention; and FIG. 8 is a similar view of another embodiment of a safety lawn dart of the invention.

Figure 1:
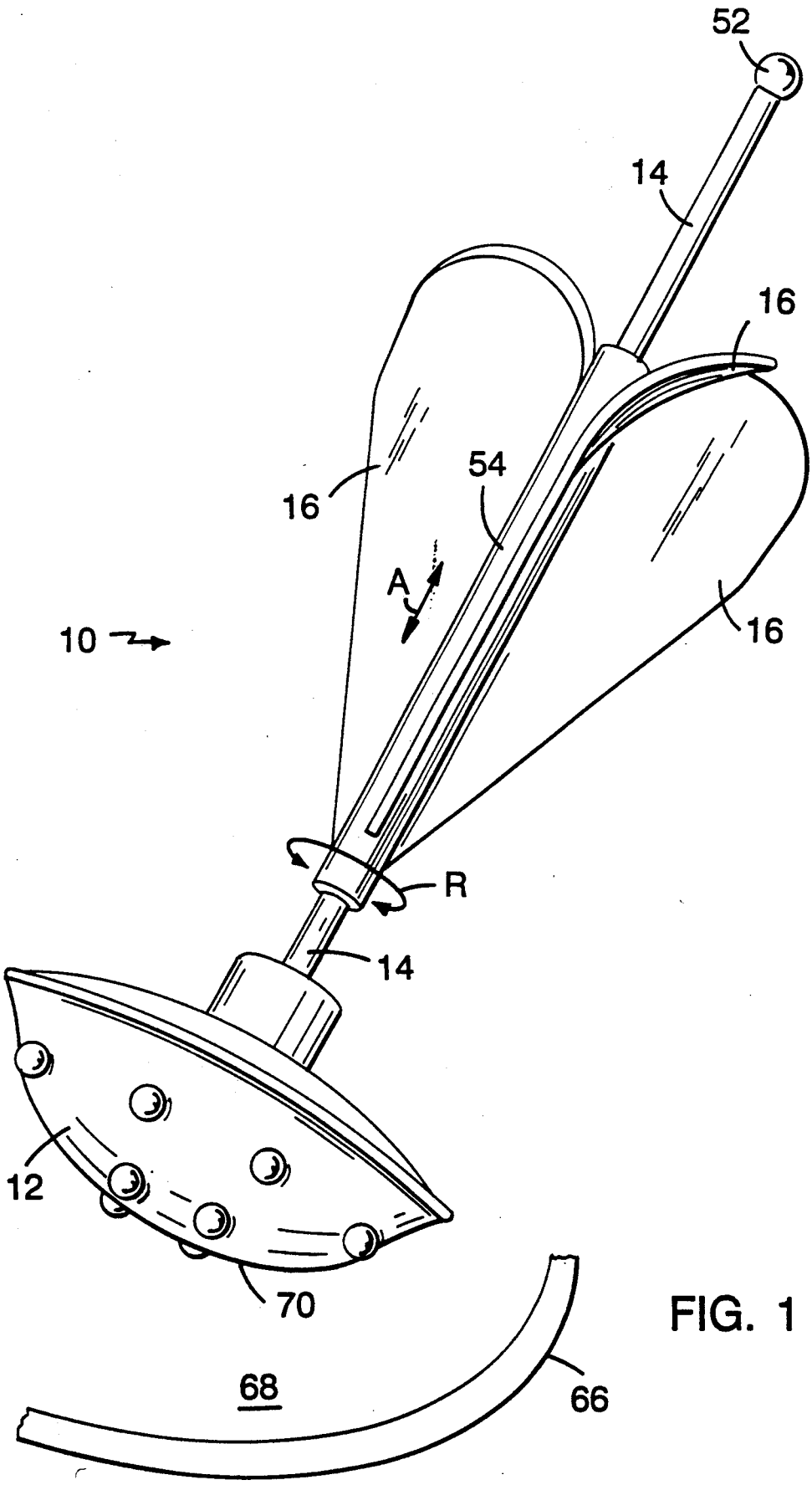

Referring to FIG. 1, a safety lawn dart 10 of the invention has a weighted, cushioned head assembly 12 mounted at the end of an elongated shaft or pitching post 14 about which are mounted fins or feathers 16.

Figure 2A:
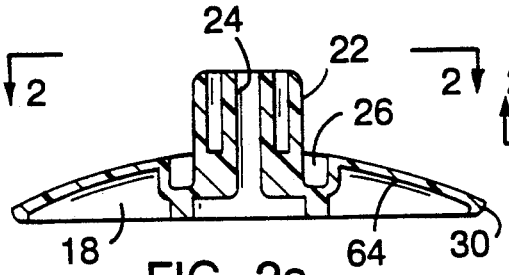
Figure 2:
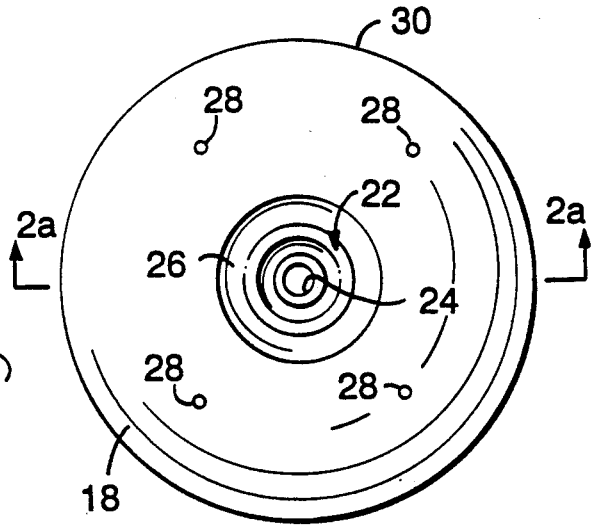
Figure 3A:
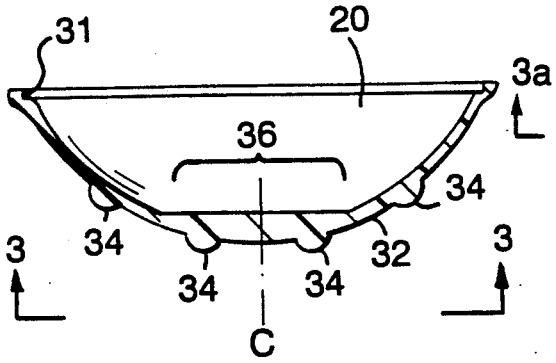
Figure 3:
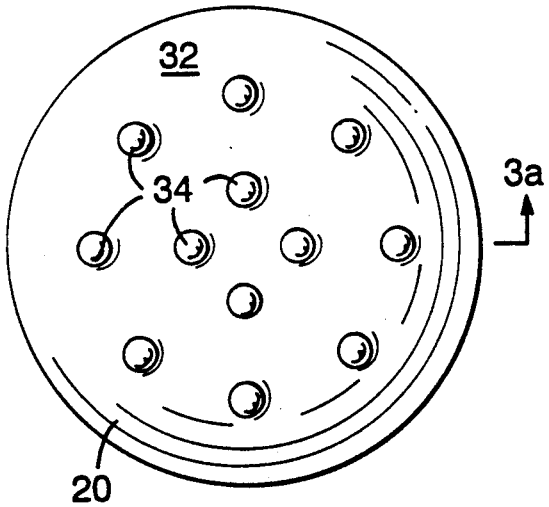

The weighted, cushioned head assembly 12 consists of a top element 18 (FIGS. 2 and 2*a*) and a bottom element 20 (FIGS. 3 and 3*a*), formed of a suitable material, e.g. the elements may be formed of cast polyvinyl chloride (PVC), rubber or soft plastic. The top element 18 defines a central hub 22 through which there extends an orifice 24 for receiving the end of the shaft 14 in fixed engagement. The top element further defines means for absorption of shock when the dart 10 strikes upon a target surface, including an annular channel 26 extending about the hub 22, and a plurality, e.g. four, of vent through holes 28 disposed between the channel and the rim 30 of the top element, as will be described more fully below. The bottom element 20 has a convex outer surface 32 about which there are disposed a plurality of bumpers 34, which serve the purpose of maintaining the dart in an upright position at a target. The central region 36 of the bottom element is relatively thicker toward the center axis, C, in order to provide increased mass to facilitate throwing accuracy.

Figure 5:
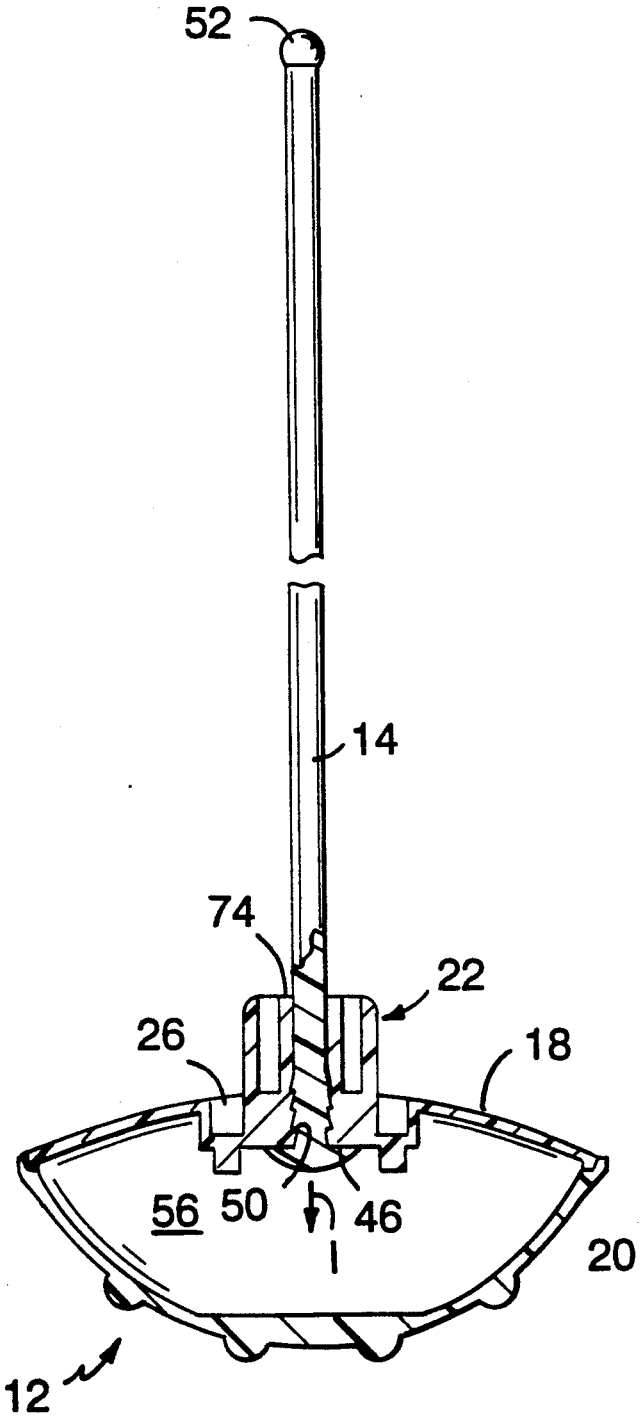
FIG. 5 is a side plan view, partially in section, of a dart head and shaft assembly of the safety lawn dart of FIG. 1.

The shaft 14, an elongated plastic rod, e.g. about 5 mm in diameter and 210 mm long, has a first end region 38, upon which the head assembly 12 is mounted (FIG. 5), and a second end region 40, which serves as a post for tossing the dart. The first end region of the shaft has an enlarged head 42 with a broad undersurface 44 which engages the opposed surface 46 of the hub 22 about the aperture 24 in a manner to prevent the head assembly 12 from being pulled off the shaft 14. A series of annular ridges 48 defined about the shaft in the first end region 38 engage the wall 50 of the hub aperture 24 in a manner to also resist movement of the first end of the shaft inwardly, in the direction of arrow I. The diameter of the shaft is uniform over the remainder of its length from the first end region to a knob 52 affixed, e.g. by threaded engagement or adhesive, at the second end of the shaft, thereby to facilitate assembly of the dart by sliding of the top element 18 of the head assembly 12 over the shaft 14 from the second end region 40 towards the first end region 38, before the knob 52 is affixed. The enlargement of the knob at upper end of the shaft also provides a gripping surface for the user.

A plurality of curved fins !6, e.g. four, are mounted upon a sleeve 54 disposed about the body of the shaft. The length and inner diameter of the sleeve 54 are selected relative to the length and outer diameter of the shaft 14 to permit the sleeve to move axially (arrow A) and rotationally (arrow R) relative to the shaft during flight, as will be described more fully below. (Similarly, the knob 52 is sized to retain the sleeve upon the shaft.) Also, referring to FIG. 6*a*, the fins 16 are curved in a manner to cause rotation or spinning of the sleeve 54 and fins 16 about the shaft 14 during flight due to movement of air axially along the shaft, in order to provide improved balance and accuracy.

Referring now to FIG. 6, the top element 18 and bottom element 20 are joined about their opposed rims 30, 31, respectively, to form a cushioned, shock-absorbing head assembly 12 defining a chamber 56. Disposed within the lower portion of the chamber 56 are a plurality of generally spherical pellets 58, formed, e.g. of a suitable deformable plastic material. The pellets 58 are contained generally in the lower segment 60 of the chamber 56 by a porous foam cushioning ring 62 which extends within the chamber 56 between the hub 22 and the inner surface 64 of the top element 18 of the head assembly 12 in the region of the rim 30.

A lawn target game employing a safety dart 10 of the invention may be played by placing a target ring 66 or the like, e.g. as shown in FIG. 1, flat upon a lawn surface 68. One or more players may then take turns tossing the darts from a predetermined distance toward the target, the objective being to cause the darts to land and remain within the target area. The construction of the safety lawn dart 10 of the invention which facilitate this objective as will now be described with particular reference to FIG. 1.

A player grasps the shaft 14 of the dart 10 in the region 40 of the second end, the undersurface of the knob 52 serving to provide a secure gripping surface. The safety lawn dart is thrown in a underhand manner, with the dart released toward the top of the arc. The safety lawn dart 10 of the invention may be thrown with improved accuracy as result of the increased mass at the tip provided by the thickened central region 36 of the bottom element 20 of the cushioned head assembly 12 and also by the weight of the cushioning means within the head assembly chamber, e.g. the plurality of plastic pellets 58 in the lower segment 60 of the head assembly chamber 56. Also, during flight, passage of air axially along the body of the dart shaft engages the curved surfaces of the fins 16, thereby causing the sleeve 54 to spin or rotate about the shaft 14 for improved balance and accuracy during flight. The sleeve 54 also slides toward a first position at the rear (second) end of the shaft, into engagement with the knob 52, in order that the balancing effect of the spinning movement of the fins may be maximized.

As the safety lawn dart 10 of the invention approaches the ground surface in the region of the target, the arrangement of the cushioned, shock-absorbing head assembly 12 and fins 16 relative to the shaft 14 typically cause the undersurface 70 of the head assembly to make initial contact. The bumper elements 34 defined about the undersurface serve to maintain the dart in an upright position at the target, and also impede the dart from skidding away from the target area. The shock absorbing features of the safety lawn dart also serve to maintain the safety dart at the region of impact, thus rewarding the skill and accuracy of the thrower. In particular, the pellets 58 are maintained within the lower segment 60 of the chamber 56 by the foam cushion 64. When the head assembly strikes the target surface 68, the soft material of the bottom 20 and top elements 18 of the head assembly are deflected upward to cushion the force of impact, the channel 26 defined about the hub 22 facilitating this deflection. The pellets 58 within the chamber 56 similarly are forced upward to absorb the impact force, deforming the cushion 62 into the upper segment 72 of the chamber. Also, the vent holes 28 defined in the top element 18 of the head assembly allow air within the chamber to escape, thus reducing the resiliency of the head assembly and further serving to absorb and cushion the force of impact. Finally, as described above, the sleeve 54 upon which the fins 16 are mounted is disposed during flight at the second end of the shaft, remote from the head assembly. Upon impact of the safety dart 10 with the target surface 68, the sleeve 54 continues to travel forward, along the shaft 14 toward its second position, until it engages upon the upper surface 74 of the hub 22. The time of impact of the sleeve 54 with the hub 22 is slightly later than the time of impact of the head assembly 12 with the ground 68 in the target region, and the forward force of the sleeve 54 acts to counter the rebound (backward) force of the head assembly and shaft due to impact with the ground, thus to further absorb the force of impact and maintain the safety lawn dart at the target point.

Referring now to another embodiment of the invention, shown in FIG. 7, in a safety lawn dart 10', the weighted, cushioned head assembly 12' consists of a top element 18, as described above with reference to FIGS. 2 and 2*a*, and a bottom element 20', which is relatively deeper and more rounded than the bottom element described above with reference to FIGS. 3 and 3*a*. Again, the top and bottom elements 18, 20' are formed of a suitable material. The bottom element 20' has a rounded, smooth outer surface 32' (typically without bumpers 34 (FIG. 3), although these may also be provided). The central region 36' of the bottom element is relatively thicker toward the center axis, C, in order to provide increased mass to facilitate throwing accuracy.

Figure 4:
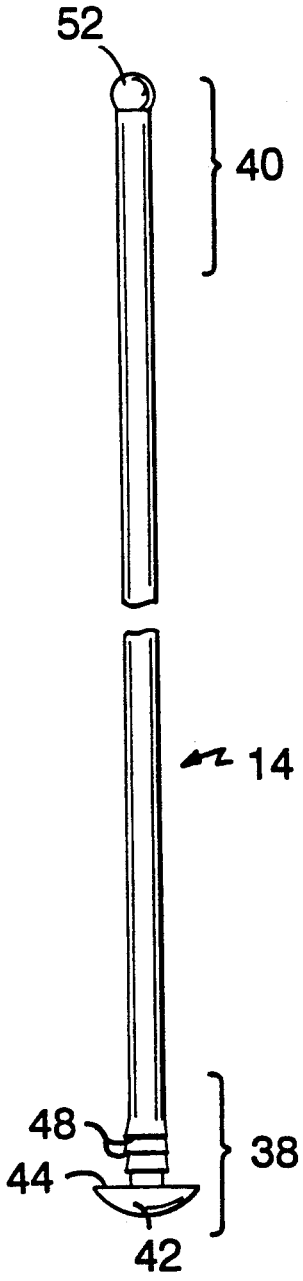
FIG. 4 is a side plan view of the dart shaft of the safety lawn dart of FIG. 1.

The shaft 14', an elongated plastic rod similar to that described with reference to FIG. 4, but with relatively shorter length (in order to provide a lower center of gravity for greater balance), has a first end region 38', upon which the head assembly 12' is mounted, and a second end region 40', which serves as a post for tossing the dart. Similar to shaft 14, the first end region of shaft 14' has an enlarged head with a broad undersurface which engages the opposed surface of the hub about the aperture in a manner to prevent the head assembly 12' from being pulled off the shaft. A knob 52' is affixed at the second end of the shaft.

A plurality of curved fins 16', e.g. four, are mounted upon a sleeve 54' disposed about the body of the shaft. A second sleeve 55' is disposed about the body of the shaft 14' above sleeve 54'. The inner diameter of the sleeve 54' is selected relative to the outer diameter of the shaft 14' to permit the sleeve to move rotationally (arrow R') relative to the shaft, and the relative lengths of the sleeve 54', shaft 14' and sleeve 55' are selected to also permit the sleeve 54' to move axially (arrow A') a predetermined distance along the shaft. A flange element 57', formed, e.g. of plastic foam, is mounted at the lower end of sleeve 55' to provide a surface for rotation of the sleeve 54', and to prevent engagement of sleeve 55' within the bore of sleeve 54'. Similarly, the knob 52' is sized to retain the sleeve 55' upon the shaft. Movement of the sleeve 54' bearing the fins 16' will be described more fully below. The fins 16' are also curved in a manner to cause rotation or spinning of the sleeve 54' and fins 16' about the shaft 14' during flight, due to movement of air axially along the shaft, in order to provide improved balance and accuracy.

The top element 18 and bottom element 20' of dart 10' are joined about their opposed rims to form a cushioned, shock-absorbing head assembly 12' defining a chamber 56'. Disposed within the mid-region of the chamber 56' is a disk-shaped hollow insert 76 of blow-molded plastic, loosely filled with granular material such as sand or the like 78. The insert 76 is sized to engage the inner wall surface 80 of the bottom element 20' in a manner to hold the insert suspended within the chamber 56', providing an empty space 82 in the bottom region to improve shock absorbency. A porous foam cushioning ring 84 extends about the chamber 56', between the wall surface 80 and the insert 76, and a second porous foam cushioning member 86 is disposed between the hub 22 and the top surface 88 of the insert, leaving an open annular space 90 in the region of the vent holes 28.

The lawn target game described above is played also using the safety lawn dart 10', the construction of the safety lawn darts 10' similarly facilitating the objective of causing the dart to land and remain upright in the target region.

The lawn dart 10' operates in a manner similar to that described above with respect to the embodiment of FIG. 1 et seq. In particular, the safety lawn dart 10' is thrown in a underhand manner, with the dart released toward the top of the arc. The safety lawn dart 10' may be thrown with improved accuracy as result of the increased mass at the tip provided by the thickened central region 36' of the bottom element 20' of the cushioned head assembly 12' and also the weight of the cushioning means within the head assembly chamber, i.e., the pliable disk-shaped insert 76 filled loosely with sand or other granular material 78 and suspended within the chamber 56', with the open, cushioning volumes 82, 90 respectively above and below the insert. Also, during flight, passage of air axially along the body of the dart shaft 14' engages the curved surfaces of the fins 16' causing the sleeve 54' to spin or rotate about the shaft 14' for improved balance and accuracy during flight. The sleeve 54' also slides toward the rear (second) end of the shaft, into engagement with the flange element 57' at the lower end of sleeve 55', in order that the balancing effect of the spinning movement of the fins may be maximized.

As the safety lawn dart 10' of the invention approaches the ground surface in the region of the target, the arrangement of the cushioned, shock-absorbing head assembly 12' and fins 16' relative to the shaft 14' typically cause the undersurface 32' of the head assembly to make initial contact. The shock absorbing features of the safety lawn dart 10' also serve to maintain the safety dart at the region of impact, thus rewarding the skill and accuracy of the thrower. In particular, the loosely filled insert 76 is maintained suspended above the empty lower region 82 of the chamber 56'. When the head assembly strikes a target surface, the soft material of the bottom 20' and top elements 18 of the head assembly 12' are deflected upward to cushion the force of impact, the channel defined about the hub facilitating this deflection. The granular material 78 within the insert 76 is similarly forced upward to absorb the impact force, deforming the cushion 86. Also, the vent holes 28 defined in the top element 18 of the head assembly allow air within the chamber to escape, thus reducing the resiliency of the head assembly and further serving to absorb and cushion the force of impact. Finally, as described above, the sleeve 54' upon which the fins 16' are mounted is disposed during flight generally against the flange element 57' on the shaft, spaced from the head assembly. Upon impact of the safety dart 10, with the target surface, the sleeve 54' continues to travel forward, along the shaft 14', until it engages upon the upper surface of the hub 22'. The time of impact of the sleeve 54' with the hub 22' is slightly later than the time of impact of the head assembly 12' with the ground in the target region, and the forward force of the sleeve 54' acts to counter the rebound (backward) force of the head assembly and shaft due to impact with the ground, thus to further absorb the force of impact and maintain the safety lawn dart at the target point.

Other embodiments are within the following claims. For example, referring to FIG. 8, in another embodiment, a safety lawn dart 100 of the invention has a cushioned, shock-absorbing head assembly 112 construction similar to those described above. Fixed feathers 116 disposed about a shaft 114 and extending from hub 122 provide the desired spinning motion during flight.

What is claimed is:

1. A safety lawn dart for use in lawn games comprising:

an elongated shaft defining an axis, said shaft having a first end region and an opposite second end region, said second end region of said shaft defining a hand gripping region, a cushion, shock-absorbing head assembly mounted at said first end region of said shaft, said head assembly comprising a hub, at least one wall element defining a chamber, and cushioning means, said wall element defining a lower surface disposed for engagement with a target surface, said hub defining a coaxial orifice, and said shaft extending through said orifice into said chamber, a sleeve mounted coaxially about said shaft, said sleeve adapted for movement axially and rotationally relative to said shaft, and a plurality of elongated flight members mounted on said sleeve and adapted to impart rotational motion to said sleeve about said axis during flight.

2. The safety lawn dart of claim 1 wherein said cushioning means comprises a plurality of pellets disposed within a first segment of said chamber during flight.

3. The safety lawn dart of claim 1, or 2 wherein said lower surface has a plurality of protrusions disposed thereupon, said protrusions extending outwardly from said lower surface for engagement with a target surface.

4. The safety lawn dart of claim 1, or 2 wherein said cushioning means further comprises at least one aperture defined by said wall element of said chamber for displacement of air from said chamber upon impact of said dart with a target surface.

5. The safety lawn dart of claim 1 or 2 wherein said sleeve is adapted to move between a first axial position upon said shaft and a second axial position upon said shaft, said sleeve in said first position being relatively more spaced from said head assembly.

6. The safety lawn dart of claim 5 wherein said sleeve is adapted for movement from said first position toward said second position upon impact of said dart with a target surface.

7. The safety lawn dart of claim 5 wherein said sleeve is adapted for movement toward said first position during flight of said dart.

8. The safety lawn dart of claim 1 or 2 wherein said shaft further comprises an enlarged head in said first end region, said head sized to resist dislodgement of said shaft from said hub, outwardly from said chamber.

9. The safety lawn dart of claim 8 wherein said shaft further comprises gripping means in said first end region for engagement with a surface of said hub to resist dislodgement of said shaft from said hub, inwardly toward said chamber.

10. The safety lawn dart of claim 1 wherein said shaft further comprises a knob element mounted in said second end region and defining a protrusion sized to arrest movement of said sleeve toward said first position.

11. The safety lawn dart of claim 10 wherein said knob element is removably mounted upon said shaft.

12. The safety lawn dart of claim 1 wherein said wall element comprises a generally concave top element having a rim and a generally concave bottom element having a rim, said top element and said bottom element being joined at the opposed rims in manner to define said chamber.

13. The safety lawn dart of claim 1 wherein said wall element has a lower central region of greater thickness relative to surrounding regions of said wall element.

14. A safety lawn dart for use in lawn games comprising:

an elongated shaft defining an axis, said shaft having a first end region and an opposite second end region, said second end region of said shaft defining a hand gripping region, a cushioned, shock-absorbing head assembly mounted at said first end region of said shaft, said head assembly comprising a hub, at least one wall element defining a chamber, and cushioning means, said wall element defining a lower surface disposed for engagement with a target surface, said cushioning means comprising an insert member defining a volume loosely filled with granular material, a sleeve mounted coaxially about said shaft, said sleeve adapted for movement axially and rotationally relative to said shaft, and a plurality of elongated flight members mounted on said sleeve and adapted to impart rotational motion to said sleeve about said axis during flight.

15. The safety lawn dart of claim 14 wherein said insert member is disposed within said chamber, and said chamber defines a first open volume region generally above said insert member and a second open volume region generally below said insert member.

16. The safety lawn dart of claim 14 wherein said lower surface has a plurality of protrusions disposed thereupon, said protrusions extending outwardly from said lower surface for engagement with a target surface.

17. The safety lawn dart of claim 14 wherein said cushioning means further comprises at least one aperture defined by said wall element of said chamber for displacement of air from said chamber upon impact of said dart with a target surface.

18. The safety lawn dart of claim 14, wherein said cushioning means further comprises a channel defined by a surface of said wall element annularly about the axis, said channel adapted to facilitate deflection of said wall element of said chamber upon impact of said dart upon a target surface.

19. The safety lawn dart of claim 14 wherein said sleeve is adapted to move between a first axial position upon said shaft and a second axial position upon said shaft, said sleeve in said first position being relatively more spaced from said head assembly.

20. The safety lawn dart of claim 19 wherein said sleeve is adapted for movement from said first position toward said second position upon impact of said dart with a target surface.

21. The safety lawn dart of claim 19 wherein said sleeve is adapted for movement toward said first position during flight of said dart.

22. The safety lawn dart of claim 14 wherein said hub defines a coaxial orifice, and said shaft extends through said orifice into said chamber.

23. The safety lawn dart of claim 22 wherein said shaft further comprises an enlarged head in said first end region, said head sized to resist dislodgement of said shaft from said hub, outwardly from said chamber.

24. The safety lawn dart of claim 23 wherein said shaft further comprises gripping means in said first end region for engagement with a surface of said hub to resist dislodgement of said shaft from said hub, inwardly toward said chamber.

25. A safety lawn dart for use in lawn games comprising:

an elongated shaft defining an axis, said shaft having a first end region and an opposite second end region, said second end region of said shaft defining a hand gripping region, a cushioned, shock-absorbing head assembly mounted at said first end region of said shaft, said head assembly comprising a hub, at least one wall element defining a chamber, and cushioning means, said wall element defining a lower surface disposed for engagement with a target surface, said cushioning means comprising a channel defined by a surface of said wall element annularly about the axis, said channel adapted to facilitate deflection of said wall element of said chamber upon impact of said dart upon a target surface, a sleeve mounted coaxially about said shaft, said sleeve adapted for movement axially and rotationally relative to said shaft, and a plurality of elongated flight members mounted on said sleeve and adapted to impart rotational motion to said sleeve about said axis during flight.

26. The safety lawn dart of claim 25 wherein said cushioning means comprises a plurality of pellets disposed within a first segment of said chamber during flight.

27. A safety lawn dart for use in lawn games comprising:

an elongated shaft defining an axis, said shaft having a first end region and an opposite second end region, said second end region of said shaft defining a hand gripping region, a cushioned, shock-absorbing head assembly mounted at said first end region of said shaft, said head assembly comprising a hub, at least one wall element defining a chamber, and cushioning means, said wall element defining a lower surface disposed for engagement with a target surface, a sleeve mounted coaxially about said shaft, said sleeve adapted for movement axially and rotationally relative to said shaft, a second sleeve disposed about said shaft in said second region and a flange element defining a surface disposed to arrest movement of the sleeve with said elongated flight members mounted thereupon toward said first position, and a plurality of elongated flight members mounted on said sleeve and adapted to impart rotational motion to said sleeve about said axis during flight.

28. A safety lawn dart for use in lawn games comprising:

an elongated shaft defining an axis, said shaft having a first end region and an opposite second end region, said second end region of said shaft defining a hand gripping region, a cushioned, shock-absorbing head assembly mounted at said first end region of said shaft, said head assembly comprising a hub, at least one wall element defining a chamber, and cushioning means, said hub defining a coaxial orifice, and said shaft extending through said orifice into said chamber, and said wall element having a plurality of protrusions disposed thereupon, said protrusions extending outwardly from said lower surface and disposed for engagement with a target surface, and a plurality of elongated flight members disposed to extend from said hub and about said shaft, said flight members adapted to impart rotational motion to said dart about said axis during flight.

29. The safety lawn dart of claim 28 wherein said wall element comprises a generally concave top element having a rim and a generally concave bottom element having a rim, said top element and said bottom element being joined at the opposed rims in manner to define said chamber.

30. The safety lawn dart of claim 29 wherein said wall element has a lower central region of greater thickness relative to surrounding regions of said wall element.

31. The safety lawn dart of claim 28 wherein said shaft further comprises an enlarged head in said first end region, said head sized to resist dislodgement of said shaft from said hub, outwardly from said chamber.

32. A safety lawn dart for use in lawn games comprising:

an elongated shaft defining an axis, said shaft having a first end region and an opposite second end region, said second end region of said shaft defining a hand gripping region, a cushioned, shock-absorbing head assembly mounted at said first end region of said shaft, said head assembly comprising a hub, at least one wall element defining a chamber, and cushioning means, said wall element defining a lower surface disposed for engagement with a target surface, said cushioning means comprising a plurality of pellets disposed within a first segment of said chamber during flight and further comprising a resilient member for securing said plurality of pellets within said first segment of said chamber during flight, said resilient member adapted to permit displacement of said plurality of pellets from said first segment of said chamber toward a second segment of said chamber upon impact of said dart with a target surface, a sleeve mounted coaxially about said shaft, said sleeve adapted for movement axially and rotationally relative to said shaft, and a plurality of elongated flight members mounted on said sleeve and adapted to impart rotational motion to said sleeve about said axis during flight.

* * * * *

UNITED STATES PATENT AND TRADEMARK OFFICE

CERTIFICATE OF CORRECTION

PATENT NO. : 5,112,062

DATED : May 12, 1992

INVENTOR(S) : Kenneth W. Pratt

It is certified that error appears in the above-indentified patent and that said Letters Patent is hereby corrected as shown below:

On title page, item [56]

References Cited (U.S. Patent Documents)

4,717,158 1/1988 Pennisi: "273/415 X" should read --273/415 XR--.

Add the following references

--2,193,645 2/1940 Raizen 273/417--
--2,911,219 11/1959 Arokiasamy 273/417--
--3,834,705 9/1974 Wong 273/417--
--4,019,738 4/1977 Tong 273/417--
--4,133,533 1/1979 Doyle 273/417--
--4,813,686 3/1989 Miranda 273/417--
--4,887,822 12/1989 Tsai 273/420--
--4,946,172 8/1990 Wong 273/420--.

Column 4, line 19, "!6" should read --16--.

UNITED STATES PATENT AND TRADEMARK OFFICE

CERTIFICATE OF CORRECTION

PATENT NO. : 5,112,062

DATED : May 12, 1992

INVENTOR(S) : Kenneth W. Pratt

It is certified that error appears in the above-indentified patent and that said Letters Patent is hereby corrected as shown below:

Column 7, line 55, claim 1, "cushion" should read --cushioned--.
Column 8, line 4, claim 3, delete "," (comma) after "1".
Column 8, line 8, claim 4, delete "," (comma) after "1".
Column 9, line 15, claim 18, delete "," (comma) after "14".

Signed and Sealed this

Fifth Day of October, 1993

Bruce Lehman

*Attest:*

BRUCE LEHMAN

*Attesting Officer*

*Commissioner of Patents and Trademarks*